US005338287A

United States Patent [19]

Miller et al.

[11] Patent Number: 5,338,287

[45] Date of Patent: Aug. 16, 1994

[54] ELECTROMAGNETIC INDUCTION HEARING AID DEVICE

[76] Inventors: Gale W. Miller, 2328 Auburn Ave., Suite 3, Cincinnati, Ohio 45219; Eugene A. Janning, Jr., 4480 Lake Forrest Dr., #308, Cincinnati, Ohio 45242; John L. Janning, 332 Vindale Dr., Dayton, Ohio 45440

[21] Appl. No.: 812,404

[22] Filed: Dec. 23, 1991

[51] Int. Cl.[5] ..... H04R 25/00

[52] U.S. Cl. ..... 600/25; 381/68.3

[58] Field of Search ..... 600/25; 128/420.5, 420.6; 181/128-130, 134-135; 381/68-69.2

[56] References Cited

U.S. PATENT DOCUMENTS

| | | | |
|---|---|---|---|
| 4,729,366 | 3/1988 | Schaefer | 600/25 |
| 4,957,478 | 9/1990 | Maniglia | 600/25 |
| 4,999,609 | 3/1991 | Crossfield | 340/572 |
| 5,015,225 | 5/1991 | Hough et al. | 381/683 |

FOREIGN PATENT DOCUMENTS 0242038 10/1987 European Pat. Off. ..... 381/68.3

*Primary Examiner*—Lee S. Cohen
*Assistant Examiner*—John P. Lacyk

[57] ABSTRACT

An electromagnetic induction type hearing aid which comprises (1) an electromagnetic transmitter having an input for receiving a radiated acoustical signal and an output for radiating an alternating electromagnetic signal whose frequency components are determined by the input signal and (2) a wireless magnetostrictive vibrator of bimorph design and of biocompatible material and which is adapted to be surgically implanted on one of the bones of the ossicular chain in a spatial operative relationship to the transmitter output without the need for mechanical anchoring and without any components passing through the boundary of the middle ear of the user. The vibrator is further responsive to the electromagnetic signal radiated from the transmitter and vibrates the ossicular chain in response to such radiated electromagnetic signal to stimulate the inner ear to create the perception of sound to the user.

6 Claims, 5 Drawing Sheets

ELECTROMAGNETIC INDUCTION HEARING AID DEVICE

TECHNICAL FIELD

The present invention relates generally to a hearing aid device which utilizes an implanted receiver/transducer.

PRIOR ART

As indicated in a preliminary report entitled SEMI-IMPLANTABLE HEARING DEVICE which was presented by Dennis I. Bojrab, et al, at the January 1988 Middle Section, Triological Society, Ann Arbor, Michigan, despite advances in modern microsurgical techniques and in electronic device technology, the vast majority of hearing impaired individuals still have not been helped. It was estimated that approximately 500 million people worldwide suffer from this handicap, including 25 million people in the United States.

Even though cochlear and various other types of inner ear and middle ear implants have made substantial advances with respect to the totally deafened individuals, this is the minority of the hearing impaired population. It is estimated that 15 percent of the hearing impaired group have benefited from various types of implants on the tympanic membrane, the cochlea, and on various bones in the middle ear, all with varying degrees of success, and that another approximately 15 percent have purchased standard acoustical type hearing aids, likewise with varying degrees of success. This results in approximately 70 percent of the entire population of hearing afflicted individuals throughout the world who have not benefited with conventionally available means, all of which have inherent limitations that reduce their effectiveness.

A conventional acoustical hearing aid may be considered as comprising two transducers, each of which "transduces" or converts one form of energy into another form of energy. The input transducer, usually in the form of a diaphragm microphone, collects the incoming sound waves on its diaphragm and converts the impinging sound waves into corresponding alternating current electrical signals which are first processed and then are amplified to a much higher energy level. The amplified electrical signals outputted from the input transducer are inputted to an electromagnetic coil which sets up a magnetic field that changes in both direction and in intensity to substantially correspond to the direction and intensity of the input signal thereto. This magnetic field alternately attracts and repels a permanent magnet attached to the diaphragm of the output transducer, thereby causing the output diaphragm to produce an audible vibration which is a substantial duplicate of the audible vibration impinging on the diaphragm of the input transducer, but at a much higher energy level. Thus, the incoming sound waves are effectively amplified prior to impinging upon the tympanic membrane, or ear drum.

One unfortunate aspect of the acoustical transducers is the fact that the overall frequency response thereof exhibits both peaks and valleys which causes a very unnatural and distorted acoustic output signal to be generated therefrom because some of the sound frequencies within the audible range are amplified to a much higher level than are other frequencies within the audible range, or, not even amplified at all. Additionally, a tight fitting ear mold is normally necessary to reduce acoustical feedback from the output transducer to the input transducer and to otherwise insure proper operation of the device. However, a tight fitting ear mold can become uncomfortable when worn over a period of time. Whenever the mold is vented, as dictated by the individual's hearing loss and/or comfort, the output signal travels back through the vent to be picked up by the diaphragm of the input transducer to produce undesirable acoustic feedback, particularly when the output volume is increased.

Numerous attempts have heretofore been made to avoid the foregoing disadvantages by the use of bone conduction hearing aids which use a special type of transducer to excite vibrations in the skull behind the ear. However, such bone conduction aids also exhibit poor frequency response and fidelity, and are usually used only with persons with deformities of the outer ear or severe ear canal drainage problems. Since it is well known that the output transducer is the basis for a significant portion of the overall distortion produced by conventional hearing aids, it has been recognized that significant acoustical advantages should be achieved by surgically implanting only the output transducer in either the middle ear or in the inner ear.

Cochlear implants are surgically implanted devices in the inner ear that do not amplify sound at the eardrum but function almost as surrogate ears. Electrical impulses generated in the device stimulate the auditory nerves directly, thereby bypassing the ear drum and the middle and inner ears. However, cochlear implants have heretofore been recommended only for an individual with profound hearing loss verging on total deafness and must be regarded as palliative at best.

Other implants have been attempted which directly drive one or more bones in the middle and/or inner ears by implanting the output transducer directly thereon. With this particular technique, there has been observed in some instances a resulting improvement in sound fidelity, a substantial decrease in frequency distortion and a virtual elimination of the undesirable acoustical feedback.

In addition to the Bojrab report previously referred to, the results of various other attempted implants are described in the following publications:

(1). Wilska, A., "Ein Methode Zur Bestimmung Der Horschwellen-amplituden Des Trommelfells Bei Verschiedenen Frequenze" *Skand Arch Physiol,* 72:161–165 1935.

(2). Wilska, A., "A Direct Method For Determining Threshold Amplitudes of The Eardrum At Various Frequencies", in *The Middle Ear,* Chicago, University of Chicago Press, pp. 76–79, 1959.

(3). Rutschmann, J., "Magnetic Audition-Auditory Stimulation By Means Of Alternating Magnetic Fields Acting On A Permanent Magnetic Fixed To The Eardrum" *IRE Trans Med Electronics,* 6:22–23, 1959.

(4). Goode, R. L., "An Implantable Hearing Aid: State Of The Art", *Trans Am Acad Ophth Otol,* 74:128–139, 1970.

(5). Goode, R. L., et al., "Audition Via Electromagnetic Induction", *Arch. Otolaryngol,* 98:25–26, 1973.

(6). Glorig, A., et al, "Magnetically Coupled Stimulation Of The Ossicular Chain: Measures In Kangroo Rat And Man", *J Acoust Soc Amer,* 52:694–696, 1972.

(7). Vernon, J., et al, "Evaluation Of An Implantable Type Hearing Aid By Means Of Cochlear Potentials", *Volta Rev,* 1:20, 1972.
(8). Frederickson, J. M., et al, "Evaluation Of An Electromagnetic Implantable Hearing Aid", *Canad J Otolaryngol,* 2:1, 1973.
(9). Mahoney, T., et al, "Speech Induced Cochlear Potentials", *Arch Otolaryngol,* 100:403–404, 1974.
(10). Vernon, J., et al, "Implantable Hearing Aids", In: Northern JL ed., *Hearing Disorders,* Boston, Little, Brown and Company, pp. 249–268, 1976.
(11). Fredrickson, J., et al, "Evaluation Of An Electromagnetic Implantable Hearing Aid", *Canad J Orolaryngol* 2:53, 1978.
(12). Suzuki, J., et al, "Problems And Solutions In The Implantation And Acoustic Characteristics Of An Implantable Artificial Middle Ear", *Artif Organs,* 9:495, 1980.
(13). Tjellstrom, A., et al, "Osseointegrated Titanium Implants In Temporal Bone: A Clinical Study Of Bone-Anchored Hearing Aids", *Am J Otol,* 2:304, 1981.
(14). Tjellstrom, A., et al, "Direct Bone Anchorage Of External Hearing Aids", *J Biomed Eng,* 5:59, 1983.
(15). Yanagihara, N., et al, "Perception Of Sound Through Direct Oscillation Of The Stapes Using Piezoelectric Aramic Bimorph", *Ann Otol Rhinol Laryngol,* 92:223–227, 1983.
(16). Suzuki, J., et al, "Problems And Solutions In The Implantation And Acoustic Characteristics Of An Implantable Artificial Middle Ear", *Artifi Organs* 9:495, 1980.
(17). Suzuki, J., et al, "Evaluation Of A Middle Ear Implant:A Six-Month Observation In Cats", *Acta Otolaryngol,* 95:646, 1983.
(18). Yanagihara, N., et al, "Development Of An Implantable Hearing Aid Using A Piezoelectric Vibrator Of Bimorph Design: State Of The Art", *Otolaryngology-Head And Neck Surgery,* 92/6, 706–712, 1984.
(19). Kiyofumi, G., et al, "Sound Pickup Utilizing An Implantable Piezoelectric Ceramic Bimorph Element: Application To The Cochlear Implant", *The American Journal Of Otology,* 5/4, 273–276, 1984.
(20). Suzuki, J., et al, "Middle Ear Implants In Humans", *Acta Otolaryngol (Stockh),* 99: 313, 1985.
(21). Tjellstrom, A., et al, "Intraosseous Transducer For Hearing By Bone Conduction. Perioperative Measurements", *J Biomed Eng,* 7:149, 1985.
(22). Hough, J., et al, "Experiences With Implantable Hearing Devices And A Presentation Of A New Device", *Annals Of Otolog, Rhinology & Laryngology,* 1:60–65, 95:60, 1986.
(23). Hough, J., et al, "A Middle Ear Implantable Hearing Device For Controlled Amplification Of Sound In The Human: A Preliminary Report", *Laryngoscope,* 97:141–151, 1987.
(24). Yanagihara, N., et al, "Development Of An Implantable Hearing Aid Of Bimorph Design: State Of The Art", *Otolaryngology-Head and Neck Surgery,* 113:869, 1987.
(25). Yanagihara, N., et al, "Implantable Hearing Aid. Report Of The First Human Applications", *Arch Otolaryngol Head Neck Surg,* 113:869, 1987.
(26). Ko, W., et al, "A preliminary Study On The Electromagnetic Implantable Middle Ear Hearing Device", *Proceedings Of The Ninth Annual Conference Of The IEEE Engineering In Medicine And Biological Society,* 1:1890, 1987.
(27). Gyo K., et al, "Measurement Of Stapes Vibration Driven By The Ceramic Vibrator Of A Middle Ear Implant-Human Temporal Bone Experiments", *Adv Audiol,* 4:107, 1988.
(28). Suzuki, J., "Middle Ear Implant:Implantable Hearing Aids", *Adv Audiol,* 4:15, 1988.
(29). Heide, J., et al "Development Of A Semi-Implantable Hearing Device, *Adv Audiol,* 4:32, 1988.
(30). Maniglia, A., et al, "An Implantable Middle Ear Hearing Aid Of The Ossicular Stimulating Type", *Ann Otol Rhinol Laryngol,* 97(suppl. 136), 1988.
(31). Tjellstrom, A., "Vibratory Stimulation Of The Cochlea Through A Percutaneous Transducer", *Adv Audiol,* 4:44, 1988.
(32). Goode, R., "Current Status Of Electromagnetic Implantable Hearing Aids, *Otolaryngol Clin Nor Am,* 22:201, 1989.
(33). Maniglia, A., "Implantable Hearing Devices, State Of The Art", *Otolaryngol Clin Nor Am,* 22:175, 1989.
(34). McGee, T. et al, "Electromagnetic Semi-Implantable Hearing Device: Phase I. Clinical Trials", *Laryngoscope,* 101: 355–360, 1991.

Of all of the different types of implants and surgical techniques known to have been attempted to date, with varying degrees of success and as exemplified by the foregoing listing, probably the most promising technique is to utilize an elongated piezoelectric vibrator of a bimorph design which is precisely positioned with the tip end thereof surgically attached either to the ear drum itself or to one or more bones of the outer and/or inner ears. However, substantial problems still remain because of (i) the necessity that an electric current must constantly pass transcutaneously to the transducer driver via implanted wires, (ii) the necessity of hermetically sealing the required wire attachments to the piezoelectric vibrator to prevent ingress of body fluid through the inlets of the wires, (iii) the substantially complex surgical implantation techniques necessary and associated inflammation control, (iv) substantial power consumption requirements of the implanted transducer, resulting in a substantial reduction in battery life, and (v) the need for a transducer which is capable of efficiently generating the required amplitude displacement and driving force.

It is therefore a primary object of the present invention to provide a new and improved hearing aid device which is relatively inexpensive as compared with other prior art devices, is relatively simple and economical to construct and install, and yet obviates many of the foregoing technical and other problems encountered with prior implanted hearing aid devices.

It is another object of the present invention to provide a new and improved hearing aid device which effectively utilizes an implanted, remotely energizable, electromagnetic induction type vibrator which avoids the need for any implanted wires in the operation thereof.

It is a further object of the present invention to provide a new and improved electromagnetic induction type hearing aid device which effectively utilizes an implanted magnetic bimorph as the receiver/transducer.

These and other objects of the present invention will become more apparent and better understood when taken in conjunction with the following description and the accompanying drawings, throughout which like characters indicate like parts and which drawings form a part of the present specification.

SUMMARY OF THE INVENTION

In accordance with the present invention, there is provided a new and improved hearing aid device which effectively utilizes an implanted electromagnetic induction type vibrator which is operatively coupled with the input transducer thereof without the necessity of intervening wires and which obviates many of the technical and other problems encountered with prior hearing aid devices.

DESCRIPTION OF THE PREFERRED EMBODIMENT

Figure 1:
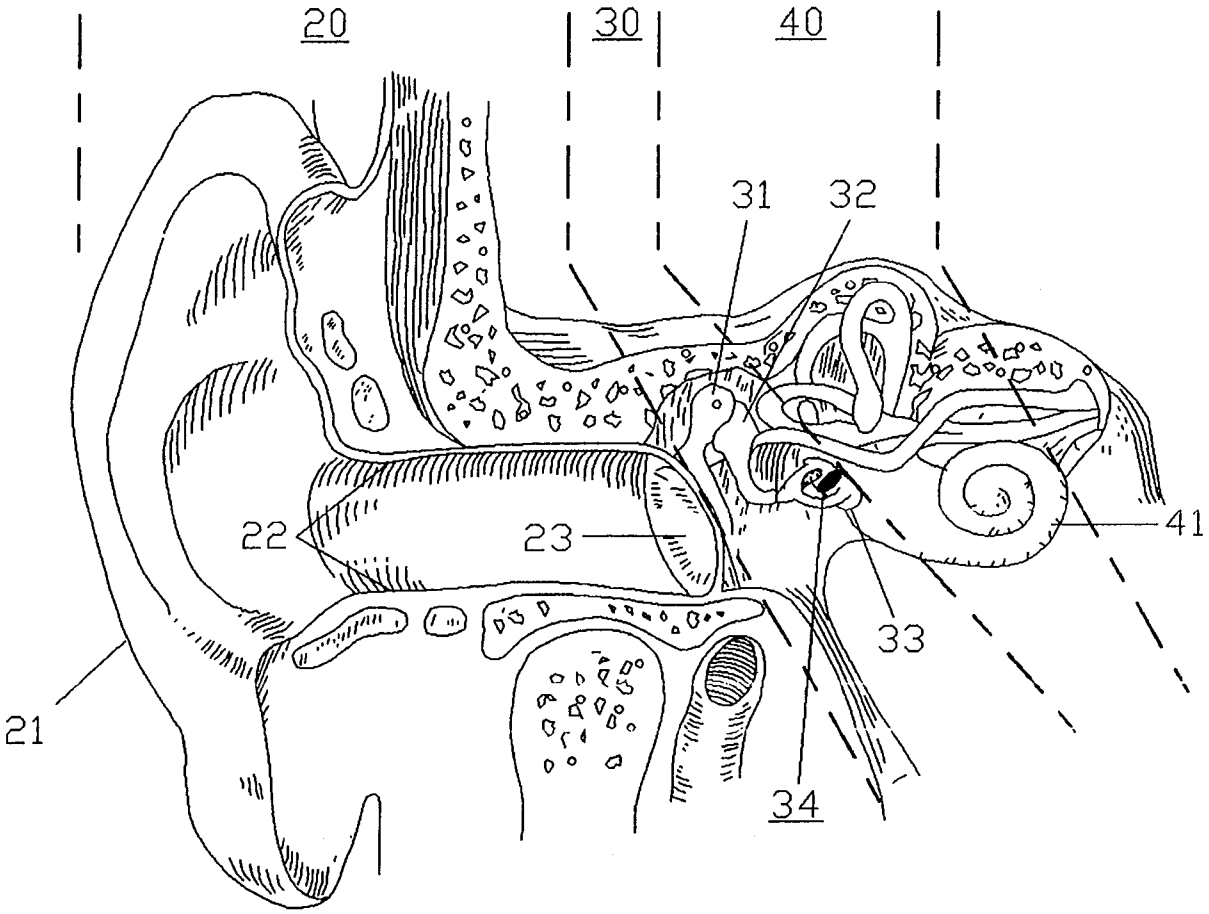
FIG. 1 is a coronal section through a human ear illustrating the hearing mechanism and an implanted magnetic bimorph.

With reference to FIG. 1 of the drawings, there is shown a simplified coronal section through a single ear illustrating the division of the hearing mechanism into three parts comprising an outer ear section 20, a middle ear section 30 and an inner ear section 40. Each outer ear section 20 essentially comprises a protrusion 21 at the side of the head, a canal 22 through which sound travels and the tympanic membrane or eardrum 23 located at the end of canal 22. Each middle ear section 30 essentially comprises an air filled space containing a chain of three small bones comprising the malleus 31, which is the largest of the three middle ear bones and generally referred to as the "hammer", the incus 32, which is an anvil shaped bone generally referred to as the "anvil", and the stapes 33, which is the smallest and stirrup shaped bona generally referred to as the "stirrup". This middle ear bone chain is generally referred to as the "ossicular" chain. Although not shown, the footplate of stapes 33 is attached to a tiny membrane, generally referred to as the "oval window", which is located at the entrance to the snail shaped cochlea 41 of inner ear 40 by means of an annular ligament that is most tense on its inferior edge and especially strong at the posterior end. Thus, any pressure exerted on stapes 33 tends to produce a corresponding displacement of the window of cochlea 41. Cochlea 41, which is that portion of inner ear 40 primarily responsible for hearing, is filled with fluids and a multiplicity of microscopic hair-like cells, not shown, which are individually connected to a different auditory nerve ending. These hair like cells within cochlea 41 likewise vibrate at the same frequency, and harmonics thereof, as the incoming mechanical displacements of the oval window thereof and thereby serve to convert the incoming vibrations/displacements into an alternating energy which drives a complex receptor organ which, in turn, essentially converts these displacements into corresponding electrochemical triggers for the acoustic nerve. The electrochemical triggers from the receptors initiates neural impulses in the afferent cells of the auditory nerve which result in related activity in the brainstem and auditory cortex through a complex set of relay stations and integrating nuclei along the way, whereby the brain interprets the signals as sound, all in the manner as described in detail in the publication "Hearing-Physiological Acoustics, Neural Coding and Psychoacoustics" by W. L. Gulick, et al, Oxford University Press, New York-Oxford, 1989.

In summary, sound waves travel from the environment through outer ear 20 and impinge upon eardrum 23. The impinging sound waves causes mechanical vibrations of eardrum 23, together with the three tiny bones 31–33 of middle ear 30. Vibrations of middle ear bones 31–33 are transmitted directly to the oval window of cochlea and thereafter through the fluids therein to thereby cause corresponding vibrations of the hair like cells within cochlea 41.

The present invention utilizes the well known facts: (i) that any sound that courses through the outer, middle and inner ears, and beyond, is heard by air conduction; (ii) that hearing by air conduction depends primarily on the functions of the outer, middle and inner ears and the neural pathways beyond; (iii) that it is possible to bypass the outer and middle ears by mechanically vibrating different ones of the middle ear bones themselves and thereby stimulate the inner ear by means of bone conduction by any of the various techniques previously described; and, (iv) that hearing by bone conduction primarily depends only on the functions of the inner ear and the sensorineural mechanism beyond and essentially bypasses any hearing barrier in either the outer or middle ears.

In accordance with a preferred embodiment of the present invention, applicants' novel hearing aid device comprises an electromagnetic transmitter operatively coupled to a remotely located receiver which is surgically implanted on the ossicular chain, without any need whatsoever of any intervening wires and in the manner to be hereinafter described in detail.

Figure 2:
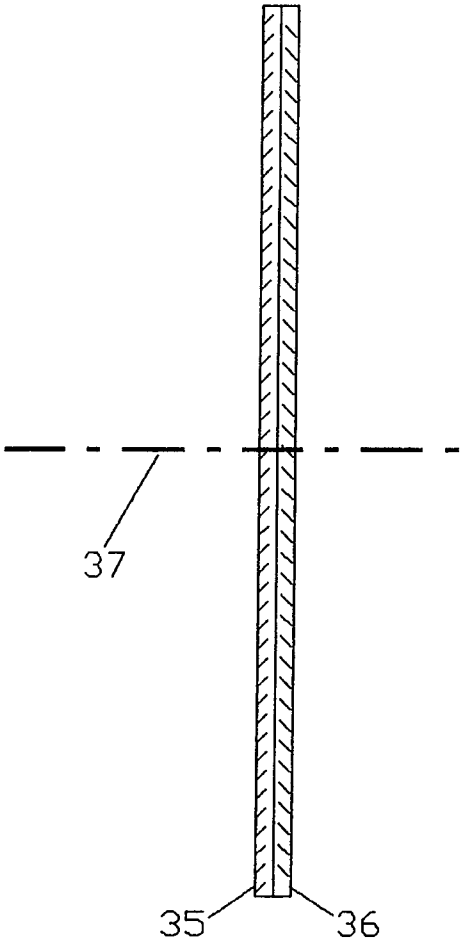
FIGS. 2(*a*) and (*b*) illustrate the construction of a typical magnetic bimorph utilized in the implementation of the present invention.
Figure 2:
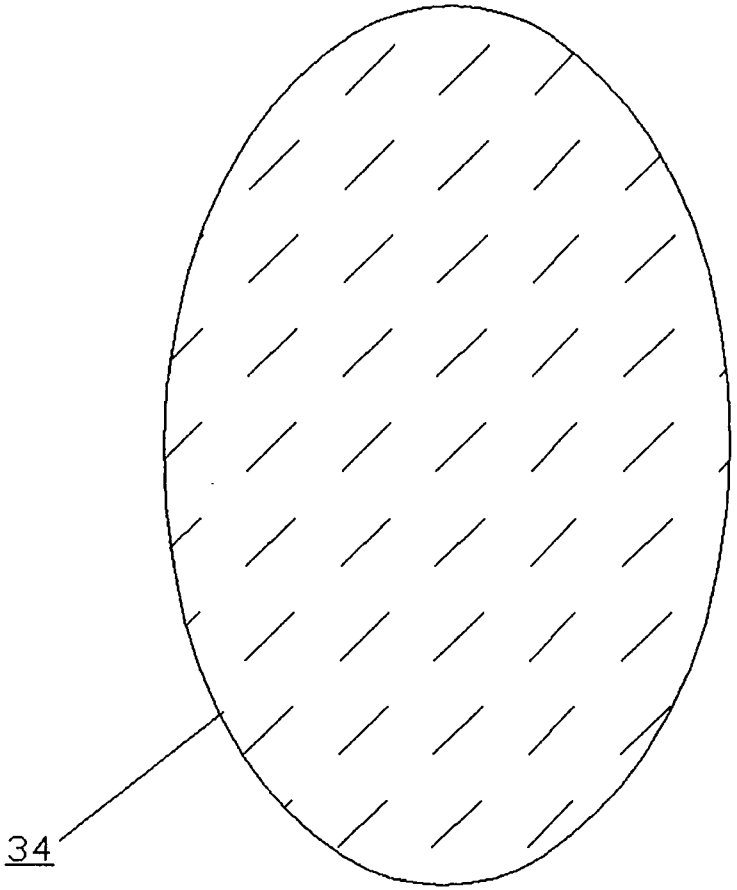

With reference to FIGS. 2(*a*) and (*b*), the receiver preferably comprises a small, electromagnetic disk 34 of bimorph construction and having a thickness in the order of 20 microns. Disk 34 may be of any geometric shape such as round, square, oval, or the like, having an overall diameter in the order of 70 thousandth of an inch, if round or square, and in the order of 40 thousandth of an inch by 55 thousandths of an inch, if oval as shown. As will be more evident hereinafter, the actual shape, thickness and overall dimensions of disk 34 will be primarily dictated by the type and magnitude of hearing correction desired and the selected location of its implantation.

Disk 34 preferably comprises a first layer of a magnetic material 34 preferably in the order of 10 microns thick and having a positive magnetic coefficient of expansion, i.e., has a positive magnetostrictive characteristic such as iron and the like which primarily expands in a planar direction when exposed to a magnetic field. Layer 34 is suitably attached to a second magnetic layer 36 also preferably in the order of 10 microns thick but having a negative magnetic coefficient of expansion, such as nickel and the like which primarily shrinks in a planar direction when exposed to the same magnetic field. When exposed to a constant magnetic field disk 34 will flex along its central axis 37 somewhat similar to a thermometer bimetallic ribbon flexing in response to a change in temperature. And, when exposed to an alternating magnetic field, disk 34 will vibrate along its central axis 37 at a frequency substantially coincidentally with the frequency of the applied magnetic field in the same manner as the action of the diaphragm of a conventional electromagnetic audio speaker as described in detail in U.S. patent Ser. No. 4,999,609 with respect to the use of a vibrating magnetic bimorph to generate an audible tone within an antipilferage device attached to articles of commerce.

Disk 34 may be fabricated in any well known manner. For example, a nickel film of desired shape and thickness may be merely deposited onto one surface of a thin sheet of iron of the same shape and thickness by means of conventional electroplating, chemical plating, or other well known techniques. Preferably, a thin layer of nickel having a thickness in the order of 10 microns is electrodeposited on one surface of thin sheet of iron having a thickness in the order of 1-2 thousandths of an inch. Thereafter, an etchant resistant photoresist pattern is preferably formed on the nickel surface thereof, which pattern conforms to the same shape and size as the desired finished disk in a well known manner. The iron-nickel bimorph substrate is then immersed into an etching solution, such as ferric chloride, and is etched until the finished disk is approximately 20 microns thick overall. Due to the fact that the entire unprotected surface of the iron sheet and the entire unprotected portion of the nickel surface will each etch entirely away during the etching process, the final desired disk conforming to the shape of the etchant resistant photoresist pattern will result. As is well known in the art, the actual etching time necessary to arrive at the desired 20 micron thickness of the final disk will vary depending upon the initial thickness of the iron sheet utilized and upon the type of etchant used and the operating temperature thereof. Following completion of the foregoing etching process, the etchant resistant coating is removed from the nickel surface and the resultant disk is then washed or otherwise cleaned in a conventional manner by the use of ultrasonics, or otherwise.

Some annealing of the disk may be required in order to both optimize the magnetic characteristics thereof and to eliminate any undesirable stresses that may have resulted during the fabrication process just described. Additionally, because certain materials are not readily acceptable for implantation within the human body, a suitable bioprotective coating is preferrably coated over the entire exposed surfaces of the disk in a well known manner.

A further alternative method of fabricating disk 34 is to secure the two selected metal or other suitable films together by soldering or by the use of a suitable adhesive in a well known manner. For example, a 10 micron thick annealed iron film of approximately one-half inch square may be adhesively secured to a 10 micron thick annealed nickel film likewise approximately one-half inch square, thereby resulting in a bimorph iron-adhesive-nickel sandwich that is approximately 20 microns thick. Thereafter, the same etchant resistant pattern is formed on both surfaces thereof in the same manner as previously described, with each of the two patterns being in registration with the other and likewise conforming to the shape and size of the desired finished disk. Etching of a disk from this iron-adhesive-nickel sandwich is done by completely etching away the entire unprotected surfaces of both the iron film and the nickel film. Thereafter, both etchant resistant coatings are removed from the nickel and iron surfaces and the resultant disk is again washed or otherwise cleaned and is then provided with a continuous film of gold by conventional means or is provided with any other suitable protective film which is compatible for implantation in a human body.

Figure 3:
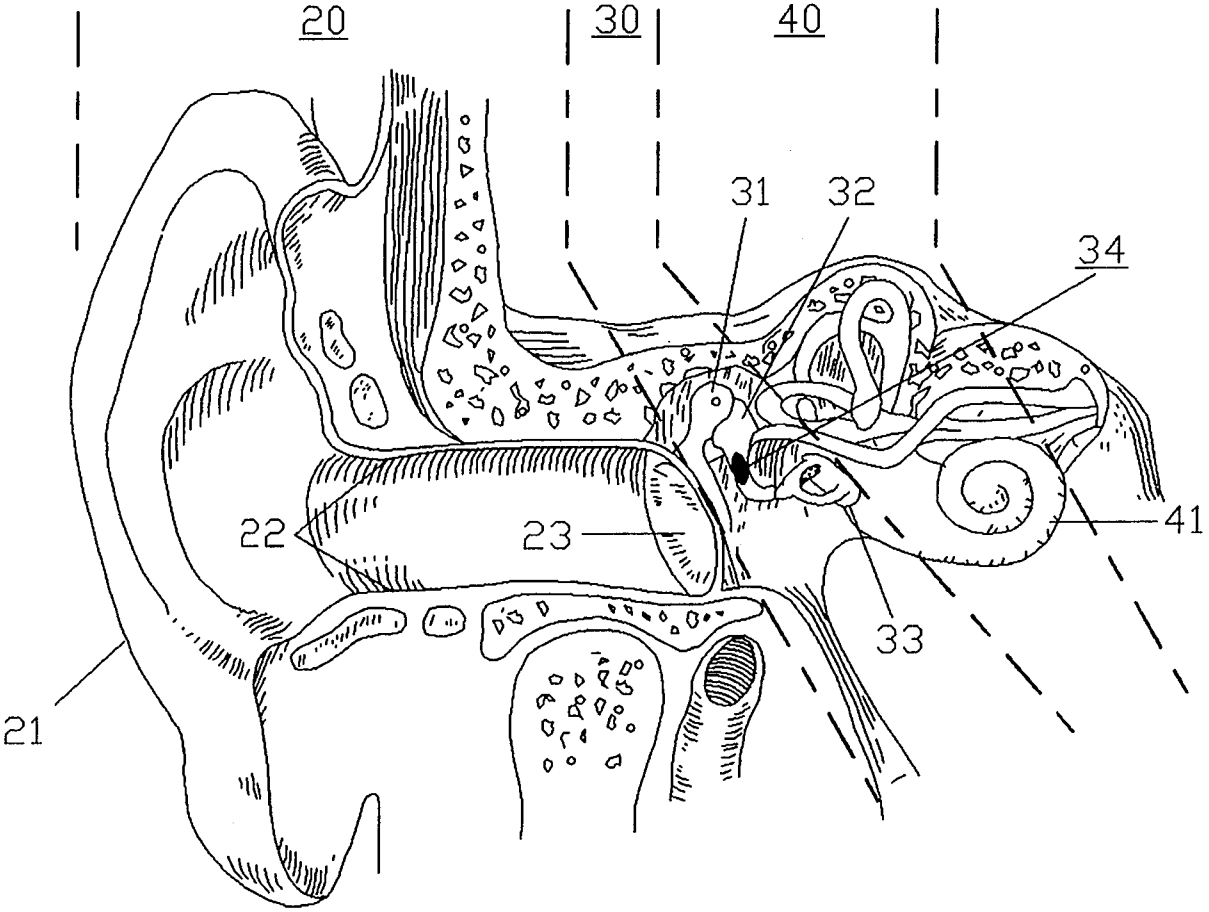
FIGS. 3 and 4 illustrate additional typical implantation locations of the magnetic bimorph; and, FIG. 5 is a diagrammatic view of the transmitter utilized in the implementation of the present invention.
Figure 4:
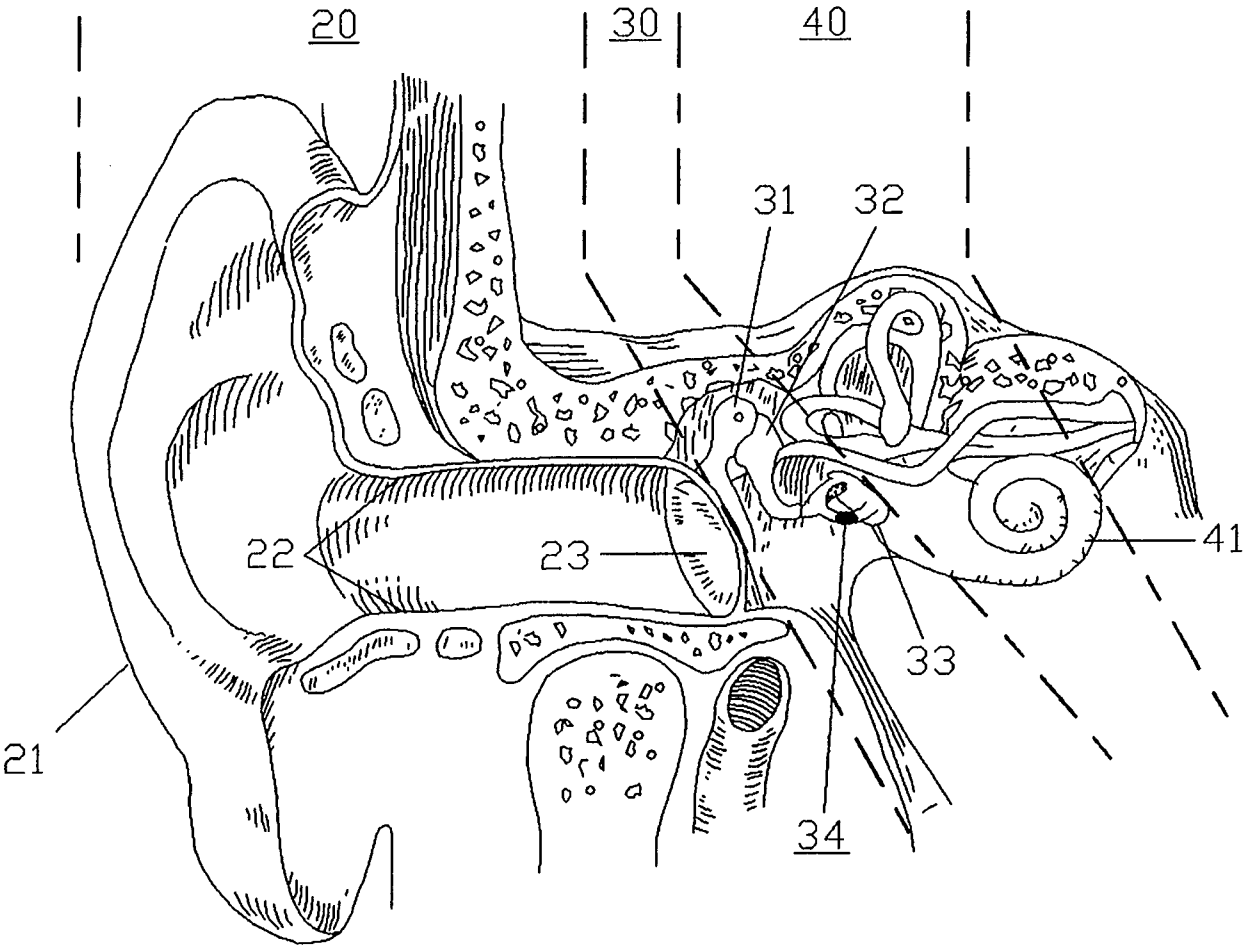

Disk 34 may be implanted on, attached to, or otherwise positioned in a driving relationship with respect to one or more of the sensory organs associated with the hearing system such as, for example, the tympanic membrane, bones comprising the ossicular chain, cochlea and/or the window thereof, mastoid bone, or even the skull, etc. For the reasons set forth in detail in the referenced prior art, the final selection of the exact implant location(s) of disk 34 will primarily depend upon the severity and the type of hearing loss desired to be corrected. However, in the preferred embodiment as illustrated in FIG. 1, disk 34 is surgically implanted on the footplate of the stapes by (i) entering the middle ear through an exploratory tympanotomy, (ii) removing the mucous membrane from the stapes footplate by the use of laser energy to vaporize it, (iii) placing disk 34 on the stapes footplate, (iv) covering disk 34 with a thin piece of fascia, and (v) closing the ear by laying back the tympanomeatal flap. FIG. 3 illustrates a bimorph typically implanted on or otherwise attached to the incus middle ear bone 32 by means of a clip attachment, whereas, FIG. 4 illustrates a bimorph wrapped around the crura portion of stapes 33.

The transmitter section of an hearing aid constructed in accordance with the present invention may simply comprise a standard audio amplifier encased within the hearing aid ear mold in substantially the same manner as in conventional hearing aids. As in conventional hearing aids, the input transducer, preferably in the form of a diaphragm microphone, collects the incoming sound waves impinging on its diaphragm, converts the impinging sound waves into corresponding alternating current electrical signals, processes and amplifies these alternating current electrical signals, and thereafter inputting these amplified signals to an electromagnetic coil which sets up a magnetic field that changes in both direction and in intensity to substantially correspond to the direction and intensity of the input signal. This alternating magnetic field is then transmitted directly to disk 34 itself, in much the same manner as the transmission of radio waves from a transmitting antenna and without the necessity of any intervening wiring whatsoever as required by prior implanted hearing aid devices. As a result, disk 34 is alternately energized in the manner as previously described, and thereby produces a substantial vibration directly at the point of implant which is likewise a substantial duplicate of the audible vibration impinging on the input microphone.

Figure 5:
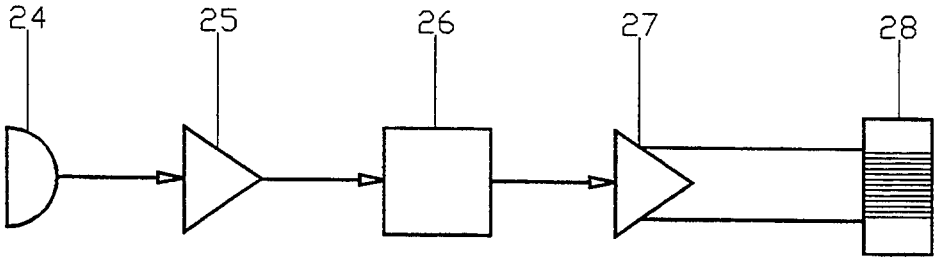

With reference to FIG. 5 of the drawings, there is illustrated a transmitter constructed in accordance with a preferred embodiment and which comprises a microphone 24 which may be of any conventional construction, including dynamic (e.g., magnetic), ceramic (e.g., piezoelectric) or electret (e.g., active). A subminiature electret microphone is preferred because of its excellent frequency response, low susceptibility to mechanical or conducted vibrations.

The output signal from microphone 24 is fed to amplifier 25 which provides all of the functions normally provided by a conventional hearing aid amplifier, including high audio gain to amplify the small amplitude signals inputted from microphone 24, manual and/or automatic gain control means, frequency shaping tailorable to individual need, and conventional noise filtering. The preferred amplifier is an Application Specific Integrated Circuit (ASIC) which is specifically designed for hearing aid use which operate at a very low power consumption in order to extend battery life and which are commonly available and currently used in conventional acoustic hearing aids. Output from amplifier 25 is inputted to compensation circuit 26 which may either be a passive or an active resistance/capacitance (RC) network and which serves to compensate for the specific transducer/bimorph transfer characteristics and thus provide a flat overall frequency response, i.e., it is tailored to match the output shaping characteristics of amplifier 25.

The output from compensation circuit 26 is inputted to driver 27 which is essentially a voltage-to-current converter which provides driving current to output transducer 28 which, in turn linearly converts the input current signal thereto to a radiated electromagnetic output field which drives implanted bimorph 34 in the same manner previously discussed. This driving technique is preferred to utilizing a voltage drive waveform in a conventional manner, since a current drive waveform results in a radiated magnetic field from transducer 28 (thus corresponding vibrations of bimorph 34) which is linearly related to the audio input voltage to microphone 24. Driving transducer 28 with a voltage driver results in a 6 dB/octave rolloff in electromagnetic field strength.

Transducer 28 preferably comprises a high magnetic permeability rod wound with many turns of very small wire. The actual dimensions of the rod and the number and size of turns of wire is chosen to optimize the strength of the operative electromagnetic field reaching bimorph 34 throughout the audio frequency band. Additionally, suitable means may optionally be provided to allow final adjustment of the axial position of transducer 28 within the molded insert which is normally placed in ear canal 22 as previously described.

Having so described and illustrated the principles of our invention in a preferred embodiment, it is intended, therefore, in the annexed claims, to cover all such changes and modifications as may fall within the scope and spirit of the following claims.

We claim:

1. An electromagnetic induction type hearing aid comprising: electromagnetic transmitting means having an input means for receiving a radiated acoustical signal and an output means for radiating an alternating electromagnetic signal whose frequency components are determined by said input signal; and, a wireless magnetostrictive vibrator of bimorph design and of biocompatible material and adapted to be surgically implanted on one of the bones of ossicular chain in a spatial operative relationship to said output means without the need for mechanical anchoring and without any components passing through the boundary of the middle ear of a user, and being further adapted to be responsive to said electromagnetic signal radiated from said output means to vibrate said ossicular chain in response to said radiated electromagnetic signal to stimulate said inner ear to create the perception of sound to the user.

2. Apparatus in accordance with claim 1 wherein said vibrator includes a first magnetic layer having a first predetermined magnetostrictive characteristic and a second magnetic layer having a different predetermined magnetostrictive characteristic than said first layer.

3. Apparatus in accordance with claim 2 wherein said magnetostrictive characteristics are of opposite types.

4. Apparatus in accordance with claim 2 wherein said first magnetic layer is iron and said second magnetic layer is nickel.

5. A method of improving the hearing of a heating impaired user which comprises the steps of:

surgically implanting of magnetostrictive vibrator of bimorph design and of biocompatible material on and in a driving relationship to one of the bones of the ossicular chain of the hearing impaired user, said vibrator being adapted to mechanically vibrate said bone at a frequency determined by alternating electromagnetic signals impinging thereon; and, positioning an electromagnetic transmitter in a spatial operative relationship to said vibrator without any components passing through the boundary of the middle ear of the user, said transmitter being adapted to receive a radiated acoustical signal and radiating an alternating electromagnetic signal whose frequency components are determined by said received signal and which causes said vibrator to vibrate said ossicular chain in response thereto to stimulate the inner ear to create the perception of sound to said user.

6. A method in accordance with claim 5 wherein said vibrator is surgically implanted on the footplate of the stapes bone of the ossicular chain.

* * * * *